US009854900B2

(12) United States Patent
Donnelly

(10) Patent No.: US 9,854,900 B2
(45) Date of Patent: Jan. 2, 2018

(54) WEARABLE UTILITY CARRYING STRAP

(71) Applicant: Christian Keene Donnelly, Walled Lake, MI (US)

(72) Inventor: Christian Keene Donnelly, Walled Lake, MI (US)

( * ) Notice: Subject to any disclaimer, the term of this patent is extended or adjusted under 35 U.S.C. 154(b) by 0 days.

(21) Appl. No.: 14/157,109

(22) Filed: Jan. 16, 2014

(65) Prior Publication Data

US 2014/0231475 A1 Aug. 21, 2014

Related U.S. Application Data

(60) Provisional application No. 61/752,978, filed on Jan. 16, 2013.

(51) Int. Cl.
*A45F 5/00* (2006.01)
*A45F 3/14* (2006.01)

(52) U.S. Cl.
CPC ..... *A45F 5/00* (2013.01); *A45F 2003/142* (2013.01); *A45F 2005/008* (2013.01); *A45F 2200/0516* (2013.01); *A45F 2200/0525* (2013.01)

(58) Field of Classification Search
CPC ..... A45F 2200/0525; A45F 2200/0516; A45F 2005/008; A45F 5/00; A45F 5/02; A45F 2005/026; A45F 2200/0508; A45F 2005/025; Y10S 224/93
USPC ..... 224/197, 222, 217–219
See application file for complete search history.

(56) References Cited

U.S. PATENT DOCUMENTS

| | | | | |
|---|---|---|---|---|
| 4,419,794 | A | 12/1983 | Horton, Jr. et al. | |
| 5,201,858 | A | 4/1993 | Otrusina | |
| 5,309,328 | A * | 5/1994 | Lum | A45F 5/00 2/170 |
| 5,604,958 | A | 2/1997 | Anscher | |
| 5,890,636 | A | 4/1999 | Kibbe | |
| 7,565,187 | B1 * | 7/2009 | Dynok et al. | 455/575.6 |
| 2003/0000976 | A1 * | 1/2003 | Malhotra | 224/197 |
| 2003/0164389 | A1 * | 9/2003 | Byers | A44C 5/0007 224/221 |
| 2006/0144883 | A1 | 7/2006 | Kouloulias | |
| 2006/0186150 | A1 | 8/2006 | Willows et al. | |
| 2006/0186152 | A1 * | 8/2006 | Williams | A45F 5/02 224/269 |
| 2006/0201978 | A9 | 9/2006 | Nichols, Sr. | |
| 2007/0170216 | A1 | 7/2007 | Davis | |
| 2007/0235493 | A1 * | 10/2007 | Fortson | A45C 11/00 224/257 |
| 2009/0013504 | A1 * | 1/2009 | Crespo | 24/306 |

(Continued)

*Primary Examiner* — Adam Waggenspack
(74) *Attorney, Agent, or Firm* — Avery N. Goldstein; Blue Filament Law PLLC

(57) ABSTRACT

An inventive wearable utility carrying strap is provided for improved user access and experience with devices mounted thereon. The wearable utility carrying strap enables a user to configure an arrangement of devices that maintains the user's desired set of device orientations even during user movement. Embodiments of the strap have one or more spring loaded stud securements that hold a device in a user specified position. Embodiments of the strap used in the inventive utility carrying strap may be formed from natural or synthetic materials including but not limited to cotton, leather, suede, polypropylene, nylon, rubber, neoprene, plastic, etc. The strap may be fitted to a user limb by adjusting the strap slack with a buckle.

5 Claims, 4 Drawing Sheets

(56) References Cited

U.S. PATENT DOCUMENTS

| | | | | |
|---|---|---|---|---|
| 2009/0057356 | A1 | 3/2009 | Woodman | |
| 2009/0321483 | A1* | 12/2009 | Froloff | A45F 5/00 224/267 |
| 2011/0031290 | A1* | 2/2011 | Remo | A45F 5/00 224/222 |
| 2011/0108589 | A1* | 5/2011 | Kim | A45F 5/00 224/222 |
| 2012/0024918 | A1 | 2/2012 | DeCamp et al. | |
| 2012/0085797 | A1* | 4/2012 | Paez | A45F 5/00 224/219 |

* cited by examiner

WEARABLE UTILITY CARRYING STRAP

CROSS-REFERENCE TO RELATED APPLICATIONS

This application claims priority of U.S. Provisional Patent Application Ser. No. 61/752,978 filed Jan. 16, 2013, which is incorporated herein by reference.

FIELD OF THE INVENTION

The present invention in general relates to the field of wearable accessories and in particular to a wearable utility strap for carrying devices with user selectable device orientations.

BACKGROUND OF THE INVENTION

Often during physical activity a person needs to hold an item for ready-access without having their movement restricted. With the proliferation of mobile computing and communication devices a need has developed for carrying these devices securely and reliably, while also accounting for a number of shapes, sizes and configurations of these devices and allowing on-the-go ready-access to features on the devices such as buttons, knobs, screens, etc.

Many special purpose holsters, clip assemblies affixed to the handset, etc. have been proposed. These devices frequently have snaps and flaps that make it difficult to take the device out and put it back. In addition, the orientation of the device is typically not held in place. Furthermore, most holsters are designed for use with a particularly shaped device, requiring different holders for each item.

Thus, there exists a need for a wearable utility carrying strap that can be used with a wide range of different portable computing and communication devices, tools, appliances and other such devices such that the device is easy to store and is available for use in a desired orientation.

SUMMARY OF THE INVENTION

An inventive wearable utility carrying strap is provided for improved user access and experience with devices mounted thereon. The wearable utility carrying strap enables a user to configure an arrangement of devices that maintains the user's desired set of device orientations even during user movement. Embodiments of the strap have one or more spring loaded stud securements that hold a device in a user specified position. Embodiments of the strap used in the inventive utility carrying strap may be formed from natural or synthetic materials including but not limited to cotton, leather, suede, polypropylene, nylon, rubber, neoprene, plastic, etc. The strap may be fitted to a user limb by adjusting the strap slack with a buckle.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DESCRIPTION OF THE INVENTION

The present invention has utility as a wearable utility carrying strap that provides for improved user access and experience with devices mounted thereon. Embodiments of the wearable utility carrying strap enable a user to configure an arrangement of devices that maintains the user's desired set of device orientations even during user movement. Embodiments of the strap have one or more spring loaded stud securements that hold a device in a user specified position. Embodiments of the strap used in the inventive utility carrying strap may be formed from natural or synthetic materials including but not limited to cotton, leather, suede, polypropylene, nylon, rubber, neoprene, plastic, etc. The strap may be fitted to a user limb by adjusting the strap slack with a buckle.

Figure 1:
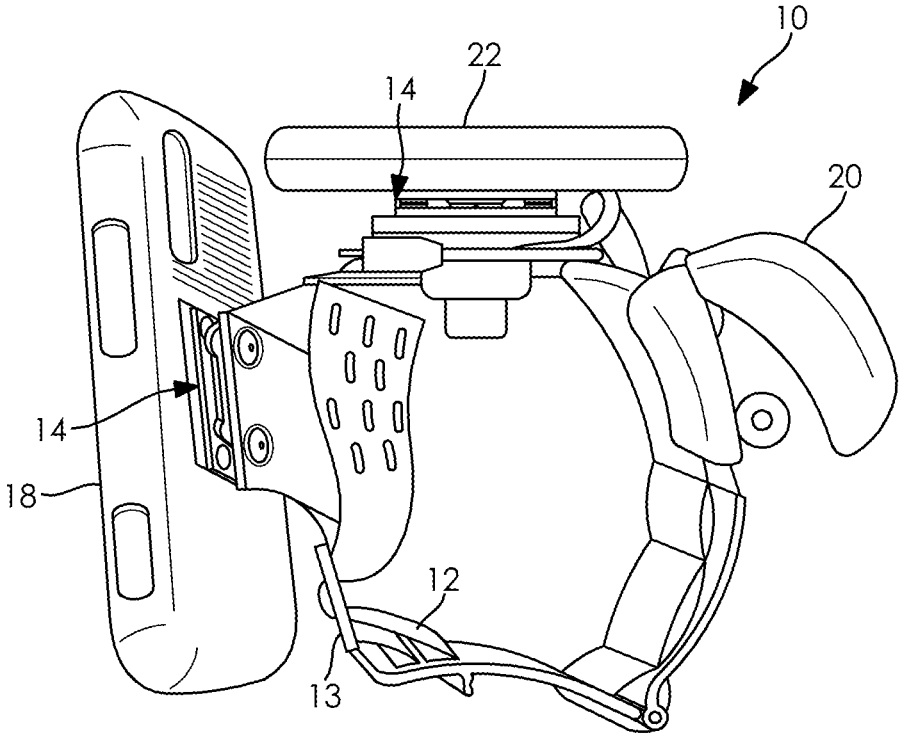
FIG. 1 is a side perspective view of an embodiment of a wearable utility carrying strap with a cellular phone, backup battery, and hands free ear piece attached.

With reference to the attached figures, an inventive wearable utility carrying strap is depicted generally at 10 in FIG. 1. The wearable utility carrying strap 10 is made up of adjustable strap 12 and buckle 13. Attached to the strap 12 are one or more spring loaded stud securements 14, and one or more loop snaps 16. The spring loaded stud securements 14, as will be described further with reference to FIGS. 3 and 4, holds or locks a secured object or device in a position determined by a user's initial placement. In the embodiment of FIG. 1, the devices that are attached to the utility carrying strap 10 with securements 14 are a cell phone 18 and an external battery 22. A hands free ear piece 20 is attached to the utility carrying strap 10 with loop snap securement 16, as will be described further in FIGS. 2A-2B.

Figure 2A:
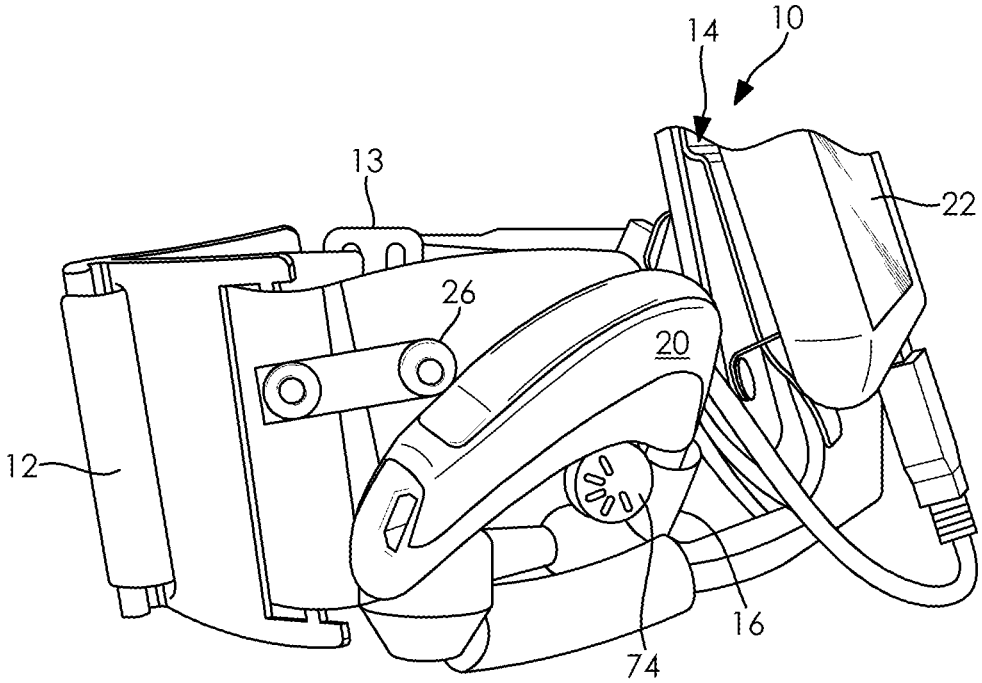
FIGS. 2A and 2B are perspective views of the embodiment of the wearable utility carrying strap of FIG. 1 showing the attachment of the ear piece.
Figure 2B:
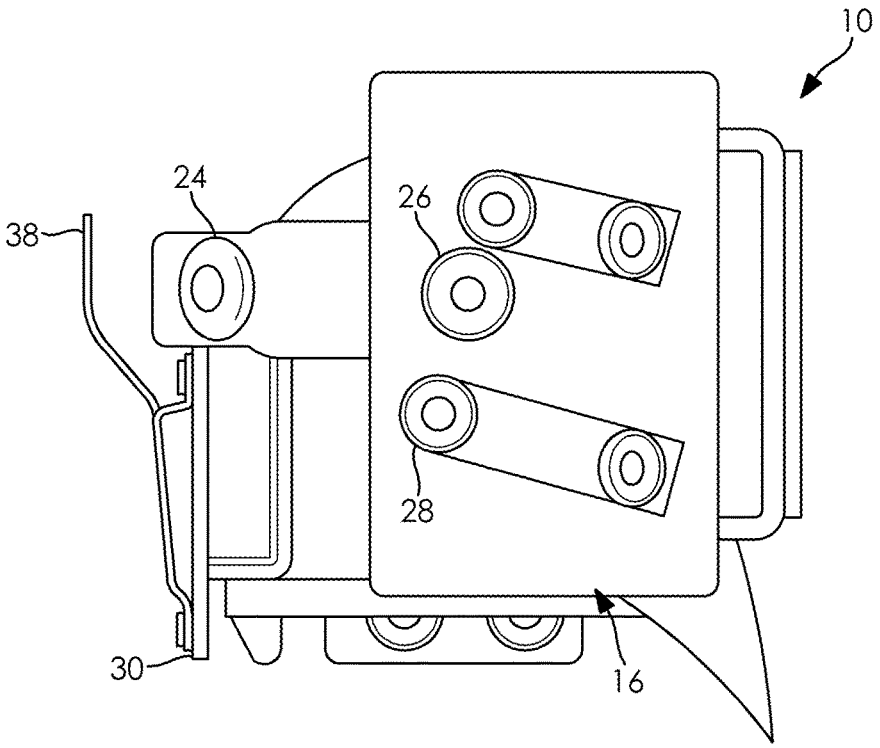

FIGS. 2A-2B are perspective views of the embodiment of the wearable utility carrying strap 10 showing the attachment of the ear piece 20. FIG. 2B illustrates an open loop snap securement 16 with loop snap 24 prior to be joined to snap post 26. In the embodiment shown, the loop snap securement 16 is attached to the strap 12 with a riveted material loop formed with rivets 28. FIG. 2B illustrates the ear piece 20 secured to the wearable utility carrying strap 10 with a closed loop snap securement 16.

Figure 3:
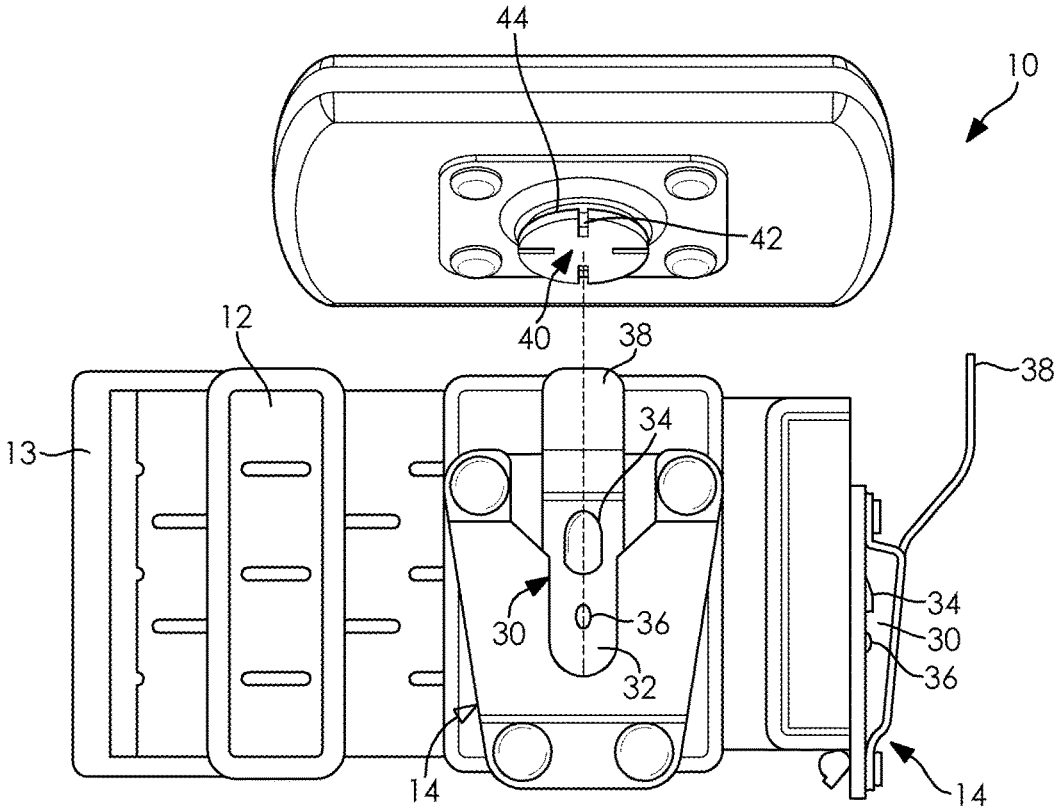
FIG. 3 is a perspective view of the embodiment of FIG. 1 illustrating the attachment mechanism for different portable computing and communication devices, tools, appliances, etc.

FIG. 3 is a perspective view illustrating the attachment mechanism or securement 14 for attaching different portable computing and communication devices, tools, appliances to the wearable utility carrying strap 10. Securement 14 is configured to hold an attached device in a set orientation, as placed by a user, even when the user moves about. Securements 14 are made of metal, plastic, or composite materials. Securement 14 has a receptacle 30 with a channel 32 for engagement with button 40. Button 40, which is affixed either directly to a device to be held, or to the device's protective case, has a groove 44 that engages or slides into the channel 32. The button 40 may be screwed into a device, or joined to a device with epoxy or glue. The surface of the button 40 has position notches 42 that engage locator bump 36 to keep the button 40 from turning once the button is engaged in securement 14. It is noted that the embodiment of the button 40 shown in FIG. 3 has four position notches 42, however more notches may be added to provide a finer degree of positional movement of an attached device. Retainer bump 34 keeps the button 40 locked in place, once the button 40 is slid into position in the securement 14. Spring tab release lever 38 is biased to provide an upward pressure that presses the engaged button 40 against the receptacle 30, and the locator bump 36 into the position notches 42, thereby locking the device into an orientation.

Figure 4:
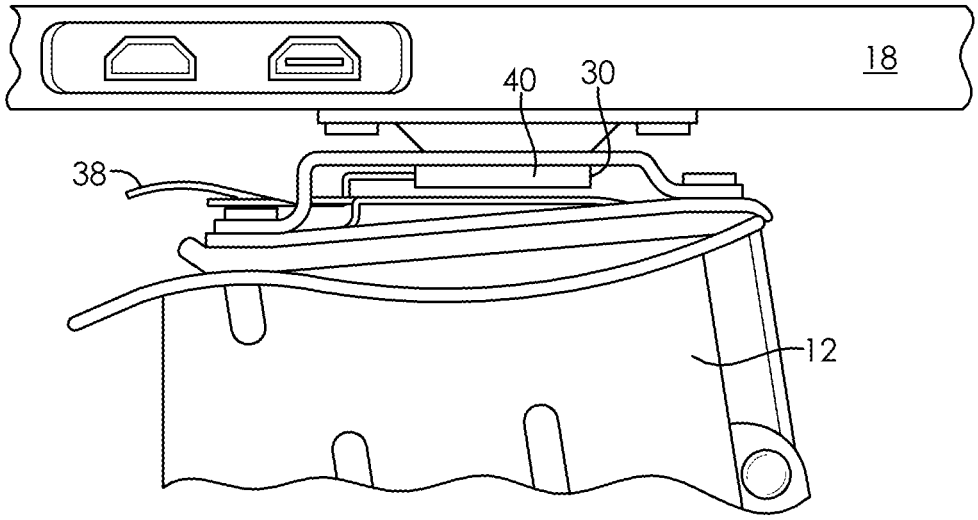
FIG. 4 is a perspective view of the embodiment of FIG. 1 illustrating the use of release lever for removal of devices from the wearable utility carrying strap.

FIG. 4 is a perspective view of that illustrate the use of release lever 38 for removal of devices from the wearable utility carrying strap 10. As shown in FIGS. 4A and 4B, by depressing on the release lever 38 the upward pressure of the release lever 38 is overcome, and the button 40 and the corresponding position notches 42 are freed from the locator bump 36 so that the device may be rotated. If the release lever 38 is pressed down further, the button 40 has enough clearance to pass over retainer bump 34, so that the device attached to the button may be removed. FIG. 4 provides a top down view of the lever 38 and shows a universal serial bus (USB) wire connection 46 from the external battery 22.

Figure 5A:
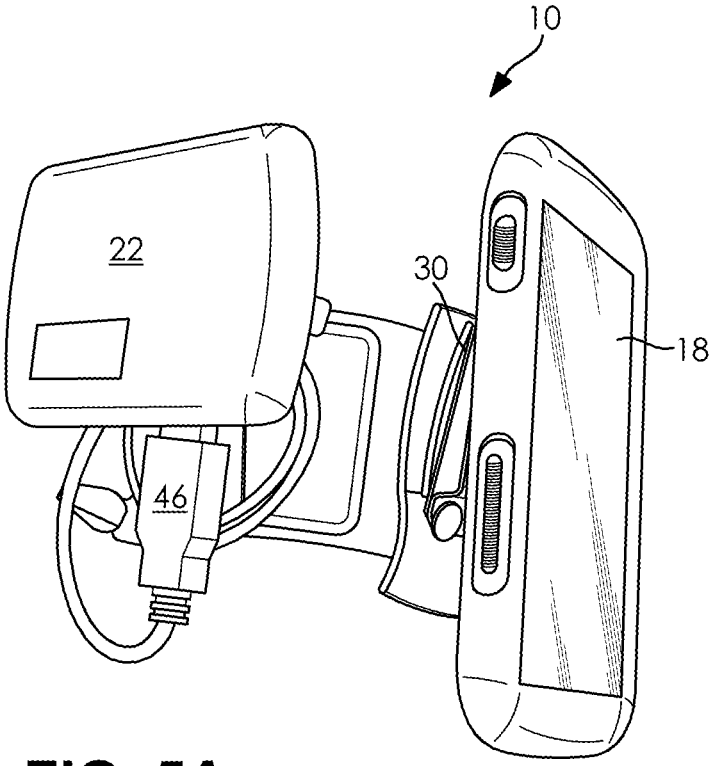
FIGS. 5A-5B are perspective views of the embodiment of FIG. 1 illustrating the wearable utility carrying strap on a user forearm and the adjustable and rotational aspects of devices mounted with the attachment mechanism.
Figure 5B:
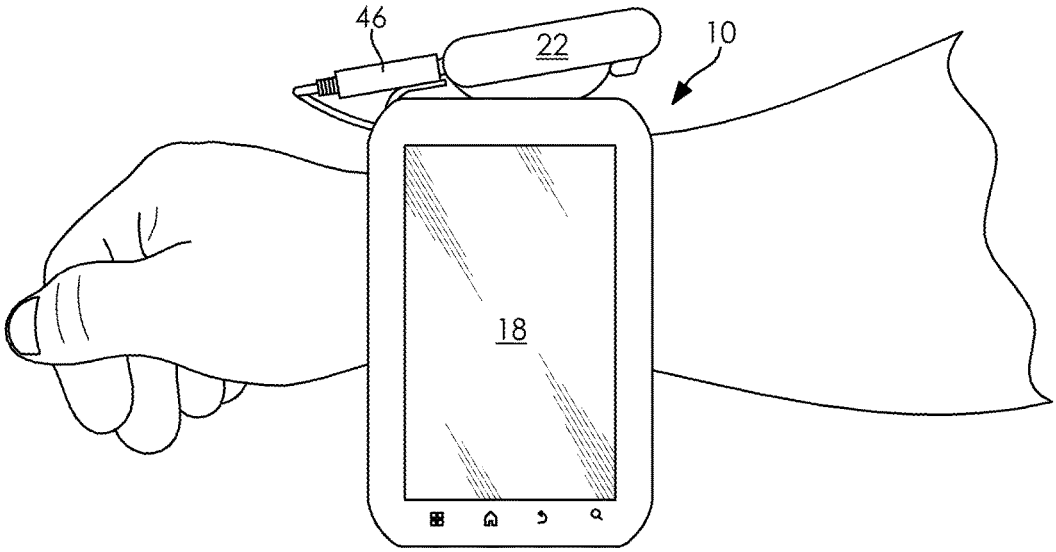

FIGS. 5A-5B are perspective views of the embodiment of FIG. 1 illustrating the wearable utility carrying strap 10 on a user forearm and the adjustable and rotational aspects of devices mounted with the attachment mechanism. In FIGS. 5A and 5B the cell phone or portable computing device 18 is locked in a vertical position, and the device 18 is also able to be locked in a horizontal position. In FIGS. 5A-5B an external battery 22 is also mounted to the wearable utility carrying strap 10.

The invention claimed is:

1. A wearable utility carrying strap comprising:

only one arm attachment structure, the arm attachment structure consisting of: an adjustable strap adapted to fasten to a user limb around a user wrist, and a buckle for adjusting slack in said strap around the user wrist;

two or more spring loaded stud securements joined to said strap, each of said two or more spring loaded stud securements further comprising: a receptacle with a channel having parallel sides terminating in a semicircular channel base and defined by an elevated central section relative to anchoring surfaces located above and below the channel and configured for engagement with a button, said button being affixed either directly to a cellular telephone or external battery therefore to be held, or to a protective case for said cellular telephone; and wherein said button has a groove that engages or slides into said channel and where said receptacle has a retainer bump located within the channel that keeps said button locked in place, once said button is slid into position within the channel in said securement;

wherein said receptacle further comprises a spring tab release lever that is biased to provide an upward pressure that presses said button against said receptacle, said spring tab release lever having a first end fixed to the anchoring surfaces and aligned with the channel and a free end having a handle portion deflecting from the anchoring surfaces towards the elevated central section and a locator bump located within the channel and closer to the semicircular base than said retainer bump into engagement with one of a series of position notches on a surface of said button to keep said button from turning, thereby locking said cellular telephone or external battery therefore into an orientation;

wherein said cellular telephone or external battery therefor in one of said spring loaded stud securements is a portable computing and communication device and in a second of said spring loaded stud securements is said external battery therefor; and wherein said one or more spring loaded stud securements maintain the individual orientations of the said cellular telephone or external battery therefor separately engaged in each of said two or more spring loaded stud securements;

an open loop snap securement configured to retain an ear piece.

2. The wearable utility carrying strap of claim 1 wherein said strap is made of synthetic materials selected from the group consisting of:—polypropylene, nylon, rubber, neoprene, and plastic.

3. The wearable utility carrying strap of claim 1 wherein said strap is fitted to a user limb by adjusting the slack of said strap with said buckle.

4. The wearable utility carrying strap of claim 1 wherein said two or more spring loaded stud securements is made of metal, plastic, or composite materials.

5. The wearable utility carrying strap of claim 1 wherein said strap is made of natural materials selected from the group consisting of: cotton, leather, and suede.

* * * * *